US010655392B2

(12) United States Patent
Cooper et al.

(10) Patent No.: US 10,655,392 B2
(45) Date of Patent: May 19, 2020

(54) HORIZONTAL DIRECTIONAL DRILLING SYSTEM

(71) Applicant: HARD ROCK HORIZONTAL DIRECTIONAL DRILLING PRODUCTS, INC., Winder, GA (US)

(72) Inventors: Cary Cooper, Winder, GA (US); Travis Parr, Winder, GA (US)

( * ) Notice: Subject to any disclaimer, the term of this patent is extended or adjusted under 35 U.S.C. 154(b) by 150 days.

(21) Appl. No.: 15/822,385

(22) Filed: Nov. 27, 2017

(65) Prior Publication Data

US 2018/0073300 A1 Mar. 15, 2018

Related U.S. Application Data

(63) Continuation-in-part of application No. 15/702,484, filed on Sep. 12, 2017, now abandoned.

(60) Provisional application No. 62/394,134, filed on Sep. 13, 2016, provisional application No. 62/528,873, filed on Jul. 5, 2017.

(51) Int. Cl.

| | |
|---|---|
| ***E21B 4/14*** | (2006.01) |
| ***E21B 7/04*** | (2006.01) |
| ***E21B 1/00*** | (2006.01) |
| ***E21B 7/06*** | (2006.01) |

(52) U.S. Cl.

CPC ..... *E21B 4/14* (2013.01); *E21B 1/00* (2013.01); *E21B 7/046* (2013.01); *E21B 7/064* (2013.01)

(58) Field of Classification Search

CPC ..... E21B 4/14; E21B 10/36

See application file for complete search history.

(56) References Cited

U.S. PATENT DOCUMENTS

| | | | | |
|---|---|---|---|---|
| 2003/0024741 | A1* | 2/2003 | Wentworth | E21B 7/046 175/73 |
| 2014/0367173 | A1* | 12/2014 | Cooper | E21B 10/38 175/87 |
| 2015/0226005 | A1* | 8/2015 | Stump | E21B 4/14 175/74 |

* cited by examiner

*Primary Examiner* — Giovanna Wright

(74) *Attorney, Agent, or Firm* — Smith Tempel Blaha LLC; Matthew T. Hoots

(57) ABSTRACT

An improved leading end assembly for a HDD percussion boring system comprises a sonde housing, a percussion hammer and a tilted-face slant bit. The sonde housing body comprises a bent engagement feature and a shoe aspect that creates an asymmetrical cross section of the sonde housing. The percussion hammer is connected to the sonde housing via the bent engagement feature which is configured to position the percussion hammer on an angle relative to a longitudinal axis of the sonde housing. The tilted-face slant bit comprises a front face facet that defines a plane that is tilted relative to a plane that is perpendicular to a longitudinal axis of the bit shaft. Advantageously, embodiments of the solution do not include a bent sub component. Rather, the shoe aspect, the bent engagement feature and the front face facet collectively form an effective bend angle (as opposed to a single, abrupt bend angle imposed by a bent sub in prior art solutions).

10 Claims, 8 Drawing Sheets

HORIZONTAL DIRECTIONAL DRILLING SYSTEM

CROSS-REFERENCE TO RELATED APPLICATIONS

This application is a continuation-in-part of the U.S. non-provisional application entitled "IMPROVED HORIZONTAL DIRECTIONAL DRILLING SYSTEM," filed on Sep. 12, 2017 and assigned application Ser. No. 15/702,484, which claims priority under 35 U.S.C. § 119(e) to the U.S. provisional application filed on Sep. 13, 2016 and assigned application Ser. No. 62/394,134 and the U.S. provisional application filed on Jul. 5, 2017 and assigned application Ser. No. 62/528,873. The entire contents of each of Ser. Nos. 15/702,484 and 62/394,134 and 62/528,873 are hereby incorporated by reference.

BACKGROUND

The present disclosure relates to a percussion boring system and, more particularly, to an improved leading end assembly for a percussion boring system in the form of a horizontal directional drilling system.

A person having ordinary skill in the art understands that horizontal directional drilling systems are capable of directionally boring a winding channel in a substrate. These channels are commonly bored for any number of purposes such as for holding a product in the form of a conductive conduit, a fiber optic cable, a stretch of tubing, a sewer pipe, etc.

Percussion boring a subterranean channel for holding a product usually begins by boring a pilot channel in a substrate along a substantially predetermined path. The pilot channel has an entry point, where the leading end of the horizontal directional drilling system initially enters the substrate, and an exit point where the leading end of the system eventually emerges from the substrate. Notably, because operators of horizontal directional drilling ("HDD") systems are often allowed very little deviation from the approved subterranean path and exit point location, an accurately set-up, calibrated and precisely steerable HDD system is desirable.

Current HDD systems used in the art, however, are limited in their ability to provide and maintain precise steering. The inability of HDD systems known in the art to provide precise steering functionality is due in some part to the reality that systems known in the art are defined by multi-component assemblies which have structural junction points that are inevitably compromised by the stress and strain of percussion boring. As one of ordinary skill in the art would understand, as the structural junction points in an HDD system become compromised due to wear and stress, the ability to accurately steer the system is also compromised. Further, because the configuration of HDD systems known in the art include a traditional bent sub component that introduces an abrupt elbow or bend in the leading end of the system, it is difficult for operators of the system to position a sonde component in a substantially level orientation such that accurate position feedback signals generated by instrumentation housed in the sonde may be received at the ground surface.

For at least the above reasons, and others, current HDD systems used in the art are difficult to accurately steer along an approved subterranean path such that an acceptable standard deviation for some applications is maintained.

Therefore, there is a need in the art for an improved horizontal directional drilling system.

SUMMARY

The present disclosure describes various embodiments, as well as features and aspects thereof, of an improved leading end assembly for a horizontal directional drilling percussion boring system. More specifically, one exemplary embodiment of a horizontal directional drilling system according to the solution comprises a drill string defining an associated first longitudinal axis and a leading end assembly comprising a sonde housing (which may contain a sub-assembly of instrumentation), a percussion hammer and a tilted-face slant bit. The sonde housing body defines an associated second longitudinal axis and comprises a bent engagement feature and a shoe aspect that creates an asymmetrical cross section of the sonde housing. The percussion hammer is connected to the sonde housing via the bent engagement feature which is configured to position the percussion hammer such that a third longitudinal axis associated with the percussion hammer intersects the second longitudinal axis associated with the sonde housing. The tilted-face slant bit is slidably connected to the percussion hammer via a chuck component. The tilted-face slant bit defines a fourth longitudinal axis associated with the axis of its shaft that may be splined. Notably, the tilted-face slant bit comprises a front face facet and may comprise a slant face facet. The fourth longitudinal axis extends through the front face facet, and the front face facet defines a plane that is tilted relative to a plane that is perpendicular to the fourth longitudinal axis.

Notably, exemplary embodiments of a horizontal directional drilling system according to the solution do not include a bent sub component. Rather, the shoe aspect, the bent engagement feature and the front face facet collectively form an effective bend angle (as opposed to a single, abrupt bend angle imposed by a bent sub). The effective bend angle is defined by an intersection of the first longitudinal axis associated with the drill string and a fifth longitudinal axis perpendicular to the plane defined by the front face facet of the tilted-face slant bit. It is envisioned that certain embodiments of the solution may impose an overall effective bend angle a range of substantially between 1.0°-15.0°, thereby providing for an operator to steer the new leading end assembly along a subterranean path without the benefit of a bent sub component. It is also envisioned that the third longitudinal axis and the second longitudinal axis may intersect to define an angle in a range of substantially between 1.0°-3.0°, although broader ranges are envisioned. The plane defined by the front face facet may be tilted between 0.25°-15.0° relative to the fourth longitudinal axis. However, the tilt angle range may be a narrower or broader (application and/or equipment specific). Notably, none of the various planes and longitudinal axes of the exemplary embodiment are collinear or parallel (I.e., any two of the axes and/or planes operate to intersect and define an angle).

Various embodiments, configurations, features and aspects of the improved leading end assembly for a percussion boring system are described in more detail in the detailed description with reference to the attached drawings.

DETAILED DESCRIPTION

Figure 1:
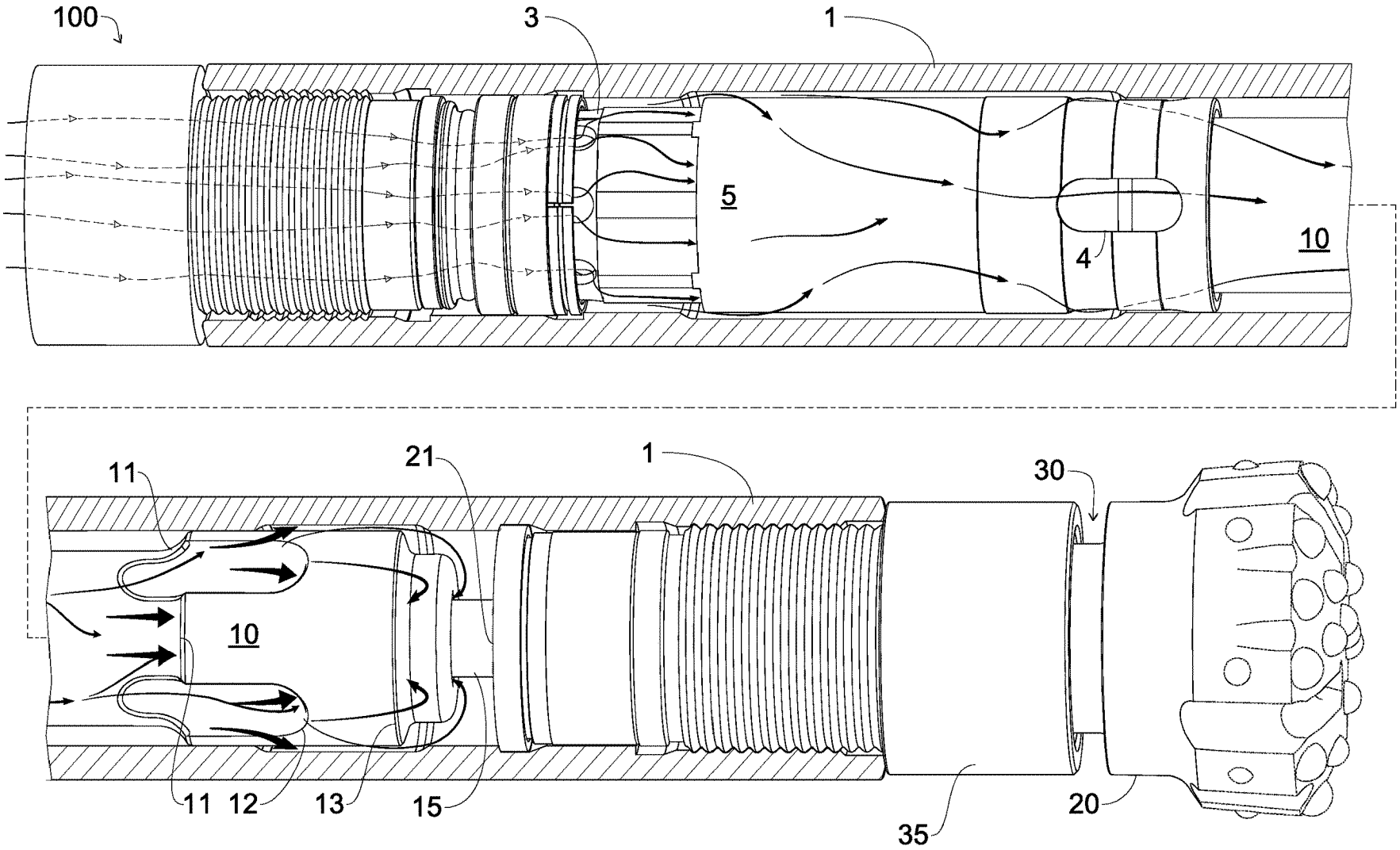
FIGS. 1-3 illustrate the basic percussive cycle of a hammer in a horizontal directional drilling ("HDD") boring arrangement.

The following written description explains various embodiments of an improved leading end assembly for a horizontal direction drilling system. This written description refers to the appended drawings to supplement the written explanation. As such, the written words should not be construed as limitations. Numerous specific details are explained in the written description and/or depicted in the drawings to provide an enabling understanding of the various embodiments to a person having ordinary skill in the art. Some details, however, need not be expressly explained because they would be readily apparent and understood by a person having ordinary skill in the art. For example, certain described embodiments and explanations of some specific details are omitted so as to not unnecessarily obscure or complicate the written description. Additionally, a person having ordinary skill in the art would understand that the various embodiments might be practiced without some or all of these specific details.

Although throughout the detailed description the various embodiments are directed towards an improved leading end assembly for a percussion boring system configured for horizontal directional drilling, it should be understood that the focus of such description is only to ensure clarity in the configuration and operation of the various embodiments. The description should not be used to limit the usefulness of the various embodiments in other manners or for other uses.

With the above in mind, the words "exemplary" and "non-limiting" are used herein to mean serving as an example, instance, or illustration. Any aspect described herein as "exemplary" or "non-limiting" is not necessarily to be construed as exclusive, preferred or advantageous over other aspects.

Certain embodiments and aspects of the present description provide a leading end assembly for a horizontal directional drilling system, the leading end assembly configured to withstand the stress of percussion boring and accurately bore a pilot hole along a predefined subterranean path. Generally, horizontal directional drilling ("HDD) is the practice of drilling non-vertical, non-linear bores. A common application for HDD is for the installation of utility products such as underground wiring, small bore piping, cable bundles, and the like. While HDD applications generally require relatively accurate boring, certain HDD applications, however, require a particularly high degree of accuracy such as, for example, a "sewer grade" bore which will be used to accommodate sewer piping. A sewer grade bore must typically have less than 0.5% deviation from the predetermined path over a 300 foot run.

The HDD process typically begins with drilling a pilot bore along a desired underground path. Next, the pilot bore is enlarged to a desired diameter and its walls conditioned by pulling a larger cutting tool, sometimes termed a "reamer" or "back reamer," back through the pilot hole. Finally, the product is installed in the enlarged hole by way of being pulled behind the reamer as the drill string is retracted from the reamed bore. Notably, the accuracy of the resulting bore relative to the predetermined path directly relates to the accuracy of the initially drilled pilot bore.

As one of ordinary skill in the art of HDD percussion boring would recognize, when drilling a pilot bore the drill string is pushing forward, thereby facilitating a percussion cycle with a hammer component and a slidably engaged drill bit on the leading end of the drill string. The hammer in an HDD drill string of this sort is not able to "run on cushion," meaning that the reciprocation of the hammer will cease upon retraction of the drill string due to a resulting "open blow" alignment of internal air passages. That is, when an HDD leading end assembly includes a hammer and a slidably engaged drill bit, the hammer cannot percuss and strike the drill bit when the drill string is being retracted.

As is understood by a person having ordinary skill in the art, the drill bit of an HDD drill string engages with the substrate to be bored and works to erode the substrate at the point of engagement during the percussion boring process. The at least one exhaust port of the bit may be configured to expel a fluid, either drilling fluid, compressed air or any other fluid known to a person having ordinary skill in the art, such that any eroded substrate at the point of engagement is cleared away from the drill bit assembly. This prevents the drill bit assembly from becoming clogged, which can restrict any necessary freedom of movement between the component parts. This also facilitates the circulation of the drilling fluid in the channel (I.e., the pilot bore), which cools the moving parts of the drill string. This also facilitates the removal of previously eroded substrate from the channel as the percussion boring process continues.

Drilling fluid may be compressed air, a viscous liquid mixture of water and bentonite, or any other similar combination known to a person having ordinary skill in the art. During a boring process, the drilling fluid is typically continuously pumped to the drill bit and expelled from ports in the drill bit. The drilling fluid may be useful for holding eroded substrate particles in suspension and lubricating the bored channel for the drill string and/or the pulled product. Advantageously, these properties of the drilling fluid help stabilize the channel walls, cool the common drill bit, alleviate the pressure on the common drill bit and prevent a building-up of substrate particles at the common drill bit during the boring process.

The drilling fluid may be recycled throughout the boring process by a reclaimer that circulates the drilling fluid expelled from the drill bit back through the channel and back through the drill string. During this recycling process, the reclaimer may additionally remove the substrate particles from the drilling fluid and regulate/maintain the drilling fluid's ideal viscosity.

Figure 2:
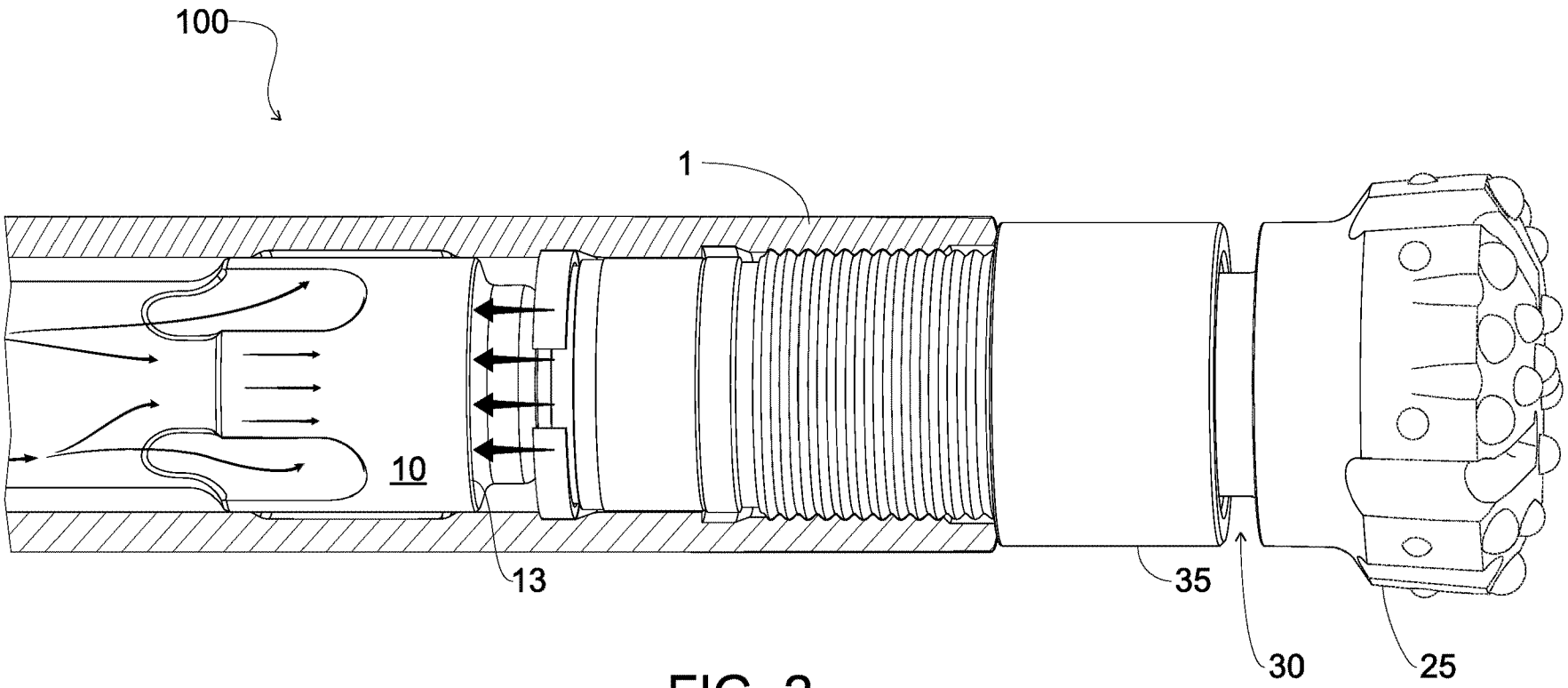
Figure 3:
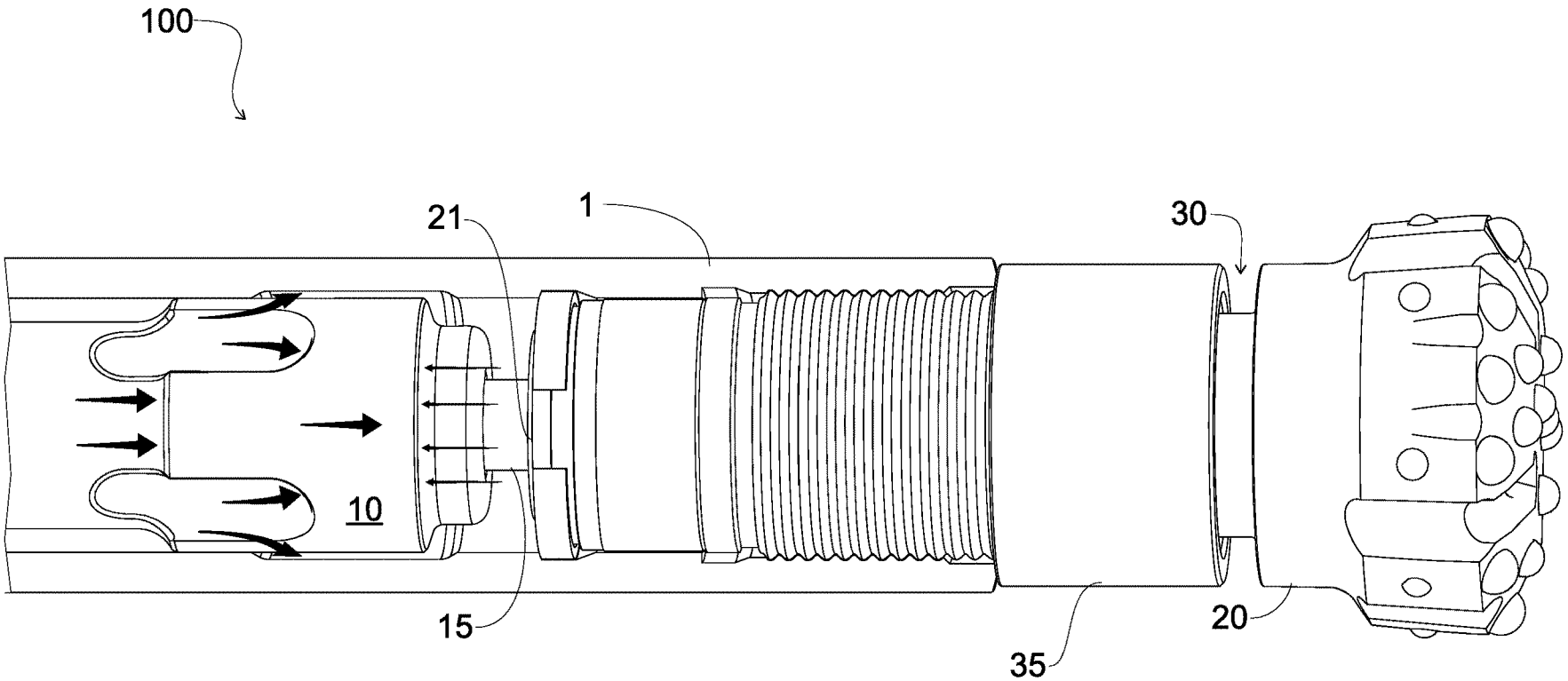

Referring to the illustrations in FIGS. 1-3, an understanding of the basic percussive cycle of a hammer in a horizontal directional drilling ("HDD") boring arrangement is useful. FIGS. 1-3 illustrate the percussive cycle delivered by a piston 10 to the impact surface 21 of a drill bit 20 in an HDD drill string configured for boring. In the FIGS. 1-3, the drill string may be envisioned as providing a feed force from left to right. As one of ordinary skill in the art would understand, as the feed force is applied (I.e., as the drill string is pushed forward), the percussive cycle of the hammer piston 10 is promoted, thereby repeatedly delivering blows to the impact surface 21 of a slidably engaged drill bit 20. Moreover, as one of ordinary skill in the art would understand, in addition to applying a feed force, the drill string provides mechanical rotation, hydraulic fluid, electric signals, etc.

Beginning at FIG. 1, a portion of a leading end assembly of an HDD drill string is shown and includes, generally, a hammer 1 containing an air distributor 3, an inner cylinder 5 and a piston 10. Also shown in the FIG. 1 illustration is a drill bit 20. The drill bit 20 has a splined shaft and is slidably engaged with the hammer 1 via a chuck 35. The arrows indicate air flow from an air supply (or other fluid supply) delivered to the air distributor 3 from the drill string, as would be understood by one of ordinary skill in the art. As can be learned from the arrows, the air is distributed radially through a series of holes positioned circumferentially around the air distributor 3. As the air radially exits the holes of the air distributor 3, the air passes along the outer surface of the inner cylinder 5 in the hammer component 1 and toward the leading end of the drill string where the slidably engaged drill bit 20 is located.

The air continues along the outer surface of the inner cylinder 5 and passes down through a series of ports 4 on the lower end of the inner cylinder 5. After passing down through the series of ports 4 on the lower end of the inner cylinder 5, the air continues along the outer surface of a piston 10 that is slidably engaged within the inner annular area of the inner cylinder 5. The air acts on and applies a force to an upper ledge(s) 11 and various "cut out" areas 12 in the piston 10, thereby causing the piston 10 to begin advancing forward (to the right in the illustration) relative to the inner cylinder 5.

The air continues to exert a greater and greater force on the upper ledge(s) 11 and the various "cut out" areas 12 in the piston 10 as it builds in pressure (the "thicker" arrows in the illustration represent forces that are relatively greater than the "thinner" arrows). As can be seen in the FIG. 1 illustration, air pressure is beginning to build up on a lower ledge 13 of the piston 10 and exerting a force back toward the inner cylinder 5. However, because the forces toward the drill bit 20 are greater, the piston 10 is advancing toward the impact surface 21 of the drill bit 20. The blow tube 15 can be seen in the FIG. 1 illustration, as it begins to engage into a central air passageway through the center of the piston 10. The air supply through the blow tube 15 ultimately exits out through the drill bit 20 and assists in the boring process. Notably, if the drill bit 20 is advanced far enough ahead of the piston 10 stroke range (such as when the drill string is being retracted), the blow tube 15 may be exposed and any air supply that would have otherwise contributed to the percussive cycle is provided with an escape route ("open blow" arrangement), as would be understood by one of ordinary skill in the art.

Turning to FIG. 2, the piston 10 has advanced forward enough that a percussive blow has been delivered to the impact surface 21 of the drill bit 20. And so, the continued supply of air pressure from the distributor 3 has begun to accumulate on the lower ledge 13 of the piston 10 and is exerting a relatively large force back toward the inner cylinder 5. The position of the drill bit 20 (the head 25 of the drill bit 20 is the "business end" of the drill bit that is hammered into the earth to create a pilot bore) can be seen relative to the chuck 35 when the piston 10 is in contact with impact surface 21 of the drill bit 20.

Notably, the gap 30 represents the "sweet spot" of the bit relative to the piston stroke range. If the drill bit 20 were advanced further to the right, the impact surface 21 of the bit 20 would be too far away from the piston 10 to receive a useful percussive blow or the percussive cycle would be interrupted. Moreover, if the bit 20 were advanced to the left such that the gap 30 is significantly reduced, the impact surface 21 of the bit 20 would be too close to the piston 10 such that the percussive blows would be detrimental to the drill string or the percussive cycle would be interrupted. As a result, in a boring configuration the drill bit 20 finds that position represented by gap 30 where the percussive cycle is urged and the piston 10 can deliver continuous blows. As the drill bit head 25 works to drill the pilot bore, pressure out ahead of the drill bit head 25 resulting from the portion of the air supply delivered through the blow tube 15 diminishes, thereby allowing the drill bit 20 to extend out of reach of the piston 10 stroke range; the advancement of the drill string, however, works to push the chuck 35 (and everything behind it in the drill string) forward relative to the slidably engaged drill bit 20, thereby providing for the continuous maintenance of gap 30.

Turning now to FIG. 3, the piston 10 has retracted to the other end of its stroke range and air pressure is starting to build up as described above relative to the FIG. 1 illustration. The piston 10 will start to advance toward the drill bit 20 to deliver its next percussive blow to the impact surface 21, after which the advancement of the drill string will work to maintain gap 30. The percussive cycle continues. Notably, it can be seen in FIG. 3 that even though the piston 10 has retracted to its left-most position in its stroke range, the gap 30 is maintained for the reasons described above. Advantageously, as long as gap 30 is maintained, I.e., as long as the impact surface 21 of the drill bit 20 is positioned in the "sweet spot" relative to the stroke range of the piston 10 in the hammer 1, the percussive cycle will repeat and percussive blows to the impact surface will be continually delivered.

Figure 4:
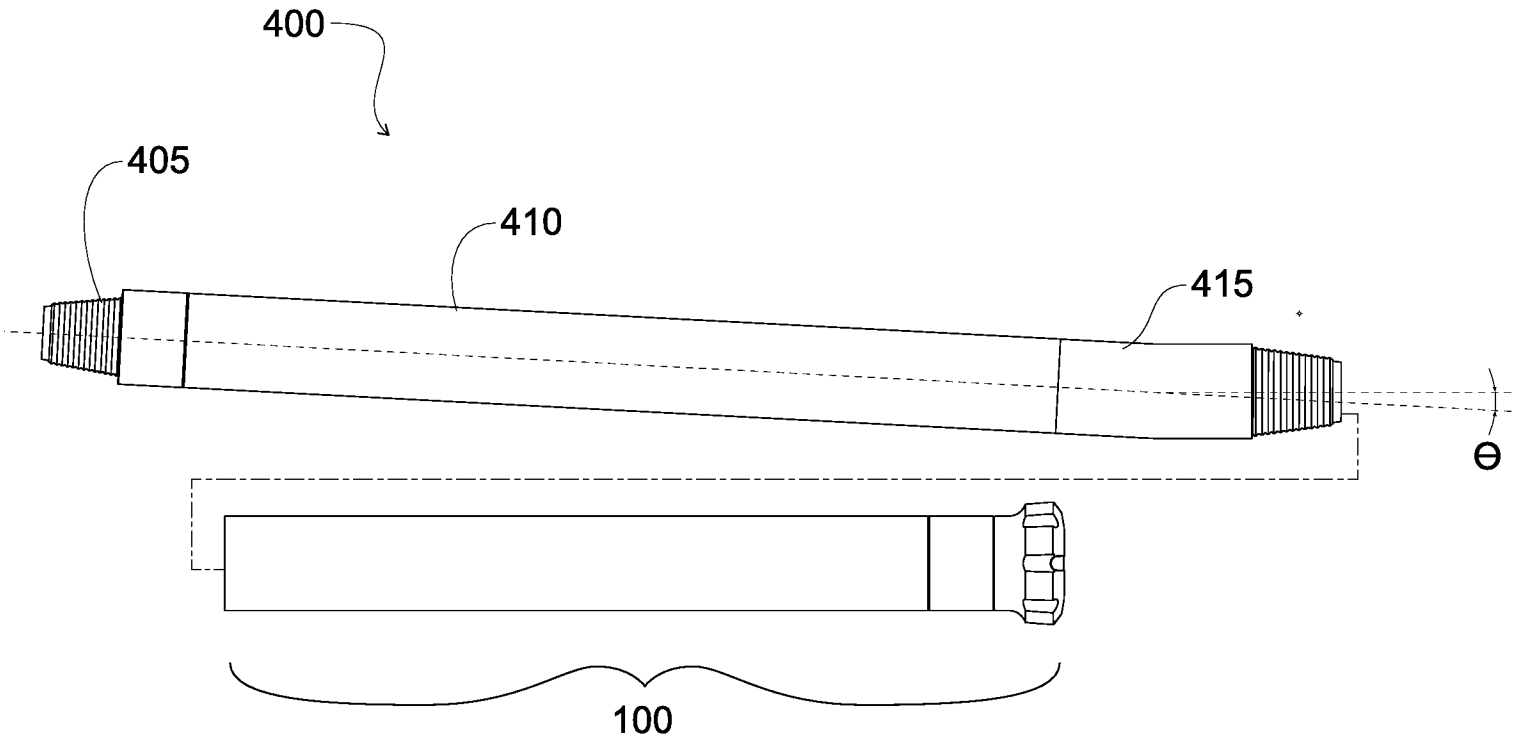
FIG. 4 illustrates certain common exemplary embodiments of HDD systems having a bent sub.

As further context to the FIGS. 1-3 illustration of a basic percussive cycle of a hammer in a horizontal directional drilling ("HDD") boring arrangement, FIG. 4 illustrates certain common exemplary embodiments of percussion boring systems known to a person having ordinary skill in the art. As can be seen in the FIG. 4 illustration, a typical HDD percussion boring system comprises a drill string (not shown) and a common leading end assembly 400. The common leading end assembly 400 typically comprises the components 100 described in the FIGS. 1-3 illustration in addition to certain other components including a sonde housing 410 and a bent sub 415. A common leading end assembly 400 may be configured to detachably and functionally couple, directly or indirectly, to the drill string via a threaded connection 405 on the backend of the sonde 410. Although not shown in the FIG. 4 illustration, as would be understood by one of ordinary skill in the art the sonde assembly 410 may house a sub-assembly 407 (see FIG. 5) of various instrumentation and transmitters for measuring and relaying various environmental conditions (e.g., the relative position of the leading end assembly in the substrate, the rotational orientation of the leading end assembly in the channel, and the thermal and pressure conditions in the channel).

As can be seen in the FIG. 4 illustration, the bent sub 415 may be coupled via a threaded connection on the leading end of the sonde 410. The bent sub 415 provides an angle or bend in the common leading end assembly 400 that allows an operator to "steer" the drill string along a subterranean path that may include one or more turns. As one of ordinary skill in the art would understand, when drilling a pilot bore along a straight section of a subterranean path, the entire drill string may be rotating while the drill bit percusses (as described above). But, when the pilot bore must take a turn in the subterranean path, rotation of the drill string may be stopped so that the bent sub 415 is positioned to urge a turn. With the bent sub 415 "clocked" to a certain position in the pilot bore, and rotation of the string stopped, advancement of the string while the bit 20 percusses will cause the pilot bore to make a turn, as would be understood by one of ordinary skill in the art. While the presence of a bent sub 415 in a leading end assembly 400 enables steering of the drill string along a curved underground path, the threaded connection of the bent sub 415 to the sonde 410 is a weak point in the drill string prone to seizing and/or wear that contributes to steering inaccuracies. Further, the abrupt bend in the drill string that is attributable to the bent sub 415 makes it difficult for an operator to position the sonde 410 in a substantially level orientation relative to the pilot bore and, as a result, position feedback signals emanating from a sonde 410 may not provide an accurate representation of the underground situation.

Referring to the sonde 410, it may be configured to house instrumentation that transmits measurement data to a percussion boring system operator at the surface, as would be understood by a person having ordinary skill in the art. The transmitted measurement data may be encoded into an electro-magnetic signal and transmitted, regardless of its encoding form, through the substrate, directly or indirectly, to the percussion boring system operator. The measurement data may be useful for determining whether the drill string should be elongated, redirected, or retracted. The measurement data may also be useful for determining the extension length and, ultimately, the amount of pressure that should be applied to the drill string as it is forced into the substrate.

The measurement data may be further useful for: determining the rotations per minute of the drill string; adjusting the rotational orientation of the common leading end assembly in the channel; adjusting the hydraulic pressure of the drilling fluid in the drill string; and controlling the circulation of the drilling fluid in the channel. Ultimately, the measurement data gathered and transmitted by the common sonde assembly 410 may also be useful and functional for controlling the relative position of the common leading end assembly, in the substrate, and the direction towards which the common leading end assembly bores.

Consequently, as is understood by a person having ordinary skill in the art, locating the relative position of the common leading end assembly 400 in the substrate, via the common sonde 410, and adjusting the rotational orientation of the common leading end assembly in the channel, via rotation of the drill string, is an important part of a directional percussion boring process. In one non-limiting variation, a "walk-over" locating system is configured to obtain measurement data from the common sonde 410, and/or locate the common leading end assembly 400 through its own sensors. Once the transmitted measurement data is received it may be decoded and/or relayed to the percussion boring system operator.

As briefly explained above, an exemplary embodiment of a bent sub 415 may be bent at an angle relative to the drill string such that the remaining components 100 of the common leading end assembly 400, below the bent sub 410, is also at angle relative to the drill string (see angle theta "θ" in the FIG. 4 illustration). The result, as is understood by a person having ordinary skill in the art, is a percussion boring system with a common leading end assembly 400 that includes a portion 100 that is slightly bent to one direction relative to the associated drill string. The specific bend angle of the bent sub 415 may be application specific.

In one non-limiting variation, a bent sub 415 comprises a bend angle range of substantially between 1.0°-3.0° relative to the longitudinal axis of the drill string substantially proximate to the common leading end assembly 400. In another non-limiting variation, the bent sub 415 and the common sonde 410 are situated relative to one another such that locating the common sonde 410, as described above, allows for an inference of the direction, in the channel, towards which the components 100 of the common leading end assembly 400 is bent. Consequently, the percussion boring system to which the bent sub 415 and the common sonde 410 pertain is configured such that any adjustment of the rotational orientation of the common leading end assembly 400 in the channel (I.e., the pilot bore), via rotation of the drill string, results in a relatively precise adjustment of the direction towards which the drill bit 20 of the common leading end assembly 400 is aimed and, ultimately, the direction towards which the common leading end assembly 400 bores.

Figure 5:
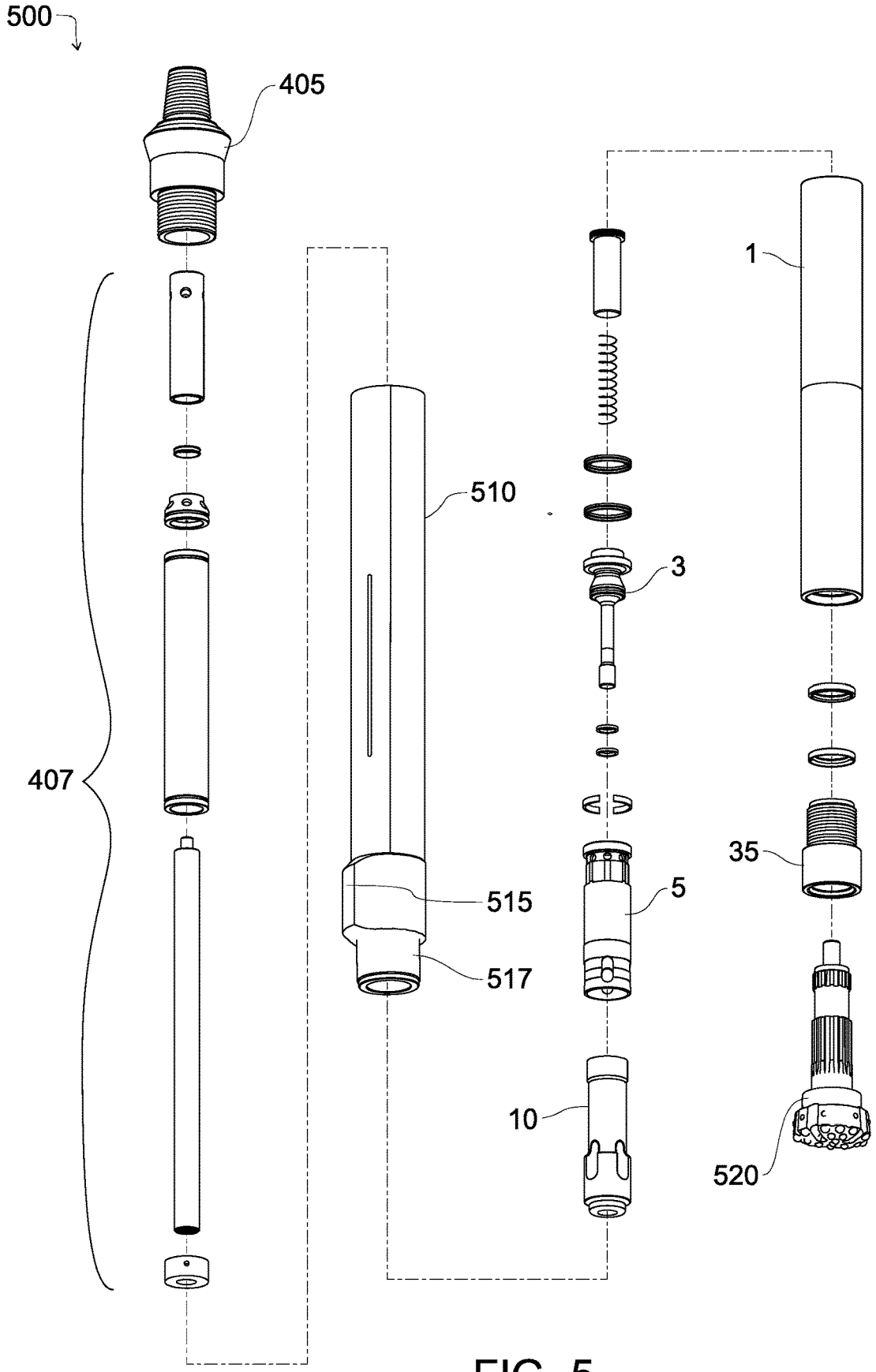
FIG. 5 is an exploded view of an exemplary embodiment of an HDD system according to the solution.
Figure 6:
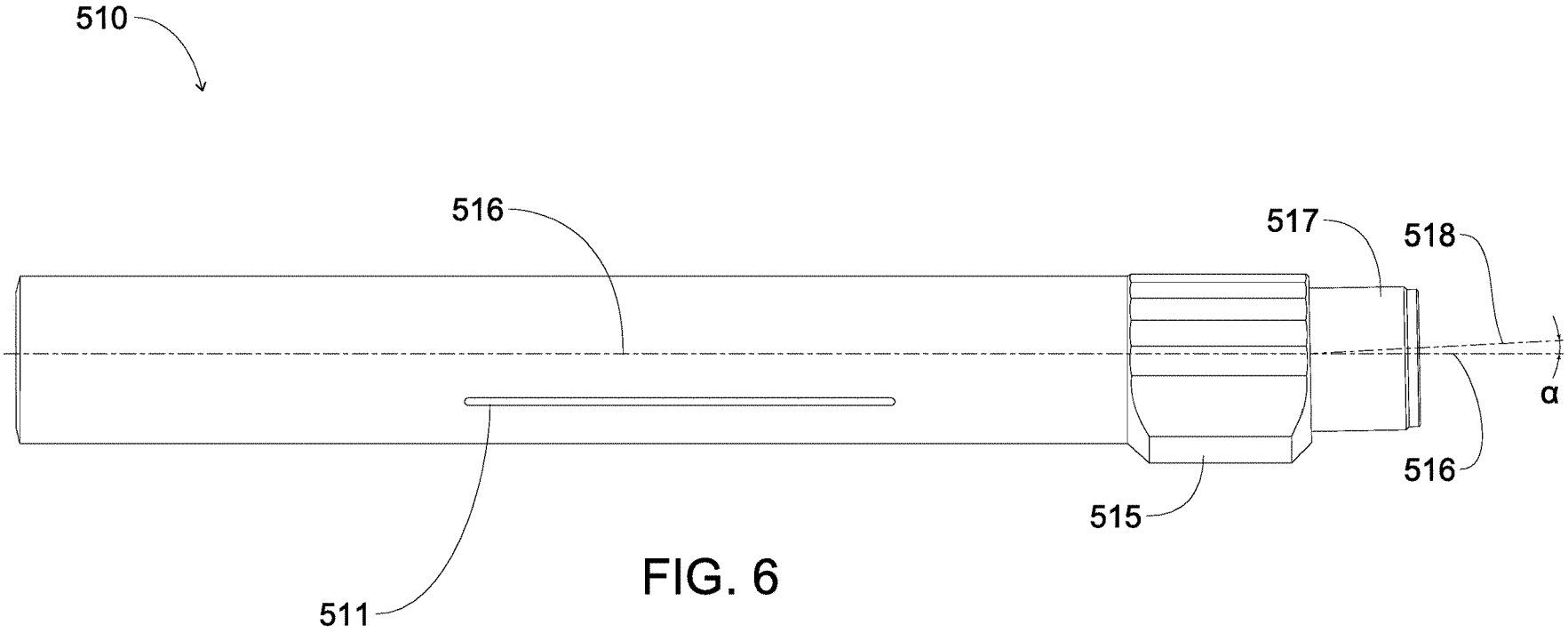
FIG. 6 is an enlarged view of the exemplary sonde housing shown in FIG. 5.
Figure 7:
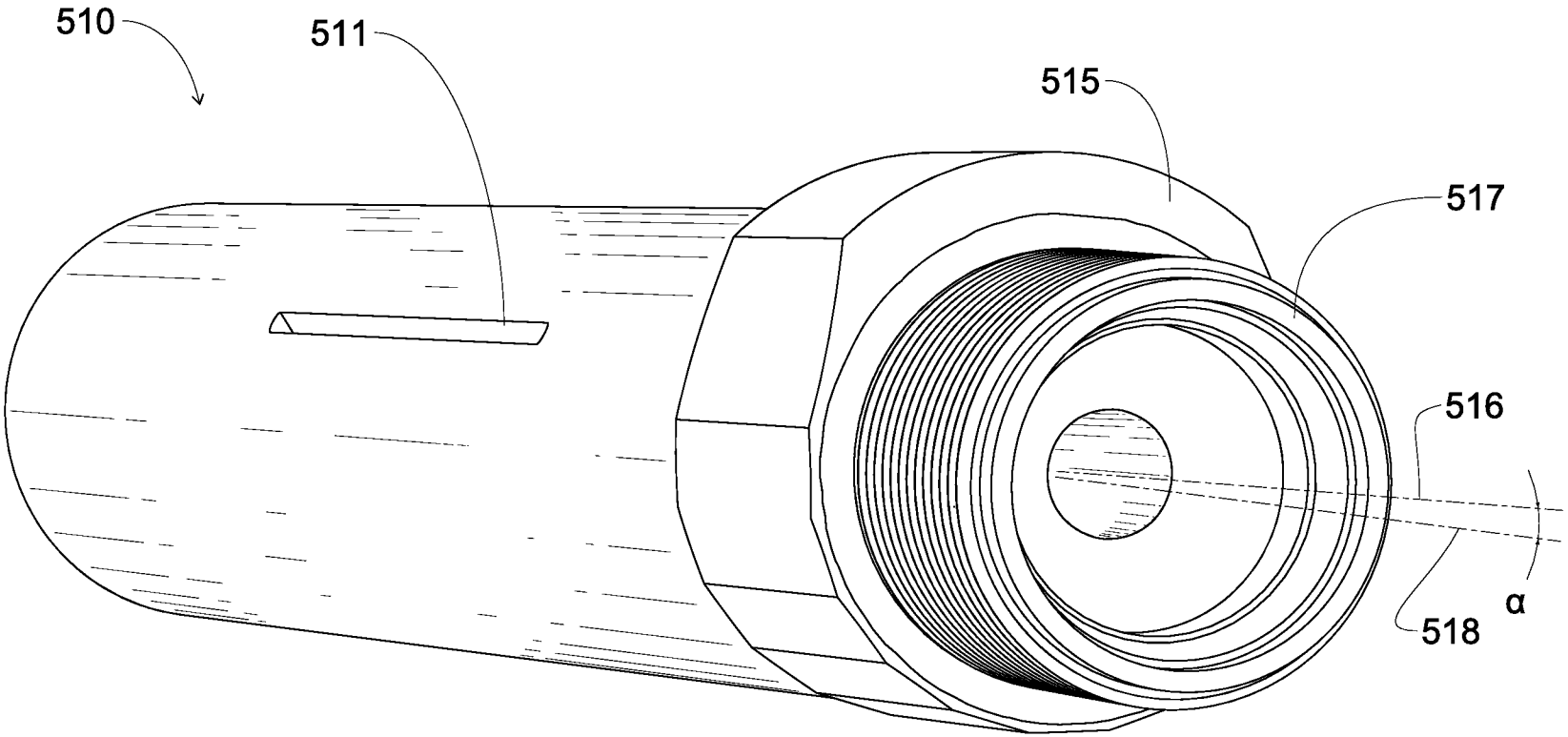
FIG. 7 is an enlarged perspective view of the exemplary sonde housing shown in FIG. 5.

Beginning now with FIG. 5, certain embodiments and aspects of the solution provide a new percussion boring system comprising a new leading end assembly 500 configured to withstand the stress of percussion boring, and for more accurate and precise boring. FIG. 5 is an exploded view of an exemplary embodiment of an HDD system according to the solution. Advantageously, exemplary embodiments of the new leading end assembly 500, unlike the common leading assembly 400 described above, comprises a streamlined, multi-component construction with no need for a bent sub component. Notably, in the FIG. 5 illustration, as well as in the FIGS. 6-8 illustrations, those components in the new leading end assembly 500 that are generally similar with, or identical to, components described relative to the common leading end assembly 400 and the percussion boring arrangement 100 are labeled in accordance with the FIG. 1-4 illustrations. By contrast, those components or aspects of the new leading end assembly 500 which are unique to the solution are identified by labels not found in the FIG. 1-4 illustrations.

Embodiments of the new leading end assembly 500 may also comprise structural reinforcement along, and/or extending across, the structural junction points of the remaining components. The structural reinforcement may, at least in part, make up for the lack of a bent sub 415. The new leading end assembly 500 does not compromise operation of the HDD percussion boring system and, instead, improves the structural integrity and resilience of the system.

Embodiments of the exemplary new leading end assembly 500 may comprise an integrated sonde shoe 515, a bent engagement feature 517, and a tilted-face slant bit 520. Notably, although exemplary embodiments illustrated in the drawings and described herein refer to a novel tilted-face slant bit, the scope of the solution is not limited to the use of tilted-face slant bits. Rather, it is envisioned that while some embodiments may include a new tilted-face slant bit (described more thoroughly relative to FIG. 8) other embodiments may leverage bits other than a tilted-face slant bit such as, but not limited to, round bits with a tilted front face, round bits without a tilted front face, slant bits without a tilted face, tilted-face straight bits (no slant face facet), straight bits without a tilted face, offset bits (centerline of head is offset relative to centerline of shaft), tilted-face offset bits, etc.

Returning to the FIG. 5 illustration, similar to the sonde housing 410, the sonde housing 510 is configured to house various instrumentation and transmitters and includes at least one elongate slit for accommodating signal transmissions. Advantageously, and as will become more apparent from the following illustrations and descriptions, combinations of an integrated sonde shoe 515 and/or bent engagement feature 517 and/or tilted-face slant bit 520 allow for a new leading end assembly 500 that does not require a bent sub 415 component.

In an exemplary embodiment of the solution, the elongate sonde body 510 is terminated, at the end opposite the drill string, by a bent engagement feature 517. The bent engagement feature 517 is an integrated aspect of the sonde body 510 and is bent at an angle relative to the longitudinal axis of the drill string/elongate sonde body 510 such that the remainder of the new leading end assembly 500, below the bent engagement feature 517, is also at an angle relative to the longitudinal axis of the drill string/elongate sonde body 510. The result, as is understood by a person having ordinary skill in the art, is a percussion boring system with a leading end assembly 500 that bends to one direction relative to its associated drill string. The specific bend angle of the new leading end assembly 500 without the bent sub may be application specific.

In one non-limiting variation, the new leading end assembly 500, without a bent sub component, comprises an effective bend angle range of substantially between 1.0°-15.0° relative to the longitudinal axis of the drill string/elongate sonde body 510. As will become more apparent from a review of FIGS. 6-8, the effective bend angle range is an aggregate bend angle resulting from aspects of the integrated sonde shoe 515 and/or bent engagement feature 517 and/or tilted-face slant bit 520. The overall effective bend angle range of an embodiment of the solution, therefore, may be defined as the angle formed at the intersection of the longitudinal axis of the drill string and an axis perpendicular to the tilted face aspect 826 of a tilted-face slant bit 520. Advantageously, because the effective bend angle range results from structural aspects spread over multiple components of the new leading end assembly 500, as opposed to a bend angle resulting entirely in a bent sub component, the elongate sonde housing 510 may be positioned in a bore nearly parallel to the bore. For this reason, location and position information transmitted from the sonde instrumentation may provide data that is relatively more accurate than what would be associated with a prior art leading end assembly that incorporates a bent sub component (I.e., the abrupt angle of a bent sub component prevents a sonde housing from being positioned parallel with the drilled bore and, as such, complicates interpretation of transmitted location and position data).

Turning now to FIGS. 5 and 6, a more detailed illustration and description of an exemplary sonde housing 510 will be provided. FIG. 6 is an enlarged view of the exemplary sonde housing 510 shown in FIG. 5. FIG. 7 is an enlarged perspective view of the exemplary sonde housing shown in FIG. 5. As can be better seen in the FIGS. 6 and 7 illustrations, the sonde housing 510 comprises a slit 511 in order to allow for transmission of instrumentation signals, as would be understood by one of ordinary skill in the art. The sonde housing 510 includes both an integrated sonde shoe 515 and an integrated bent engagement feature 517. While the exemplary novel embodiment of a sonde housing 510 shown in the FIGS. 6 and 7 illustrations includes both an integrated sonde shoe 515 and an integrated bent engagement feature 517, it is envisioned that embodiments of the solution may include sonde housings having one or the other feature 515, 517 and, as such, the scope of the solution does not require that a sonde housing include both an integrated sonde shoe 515 and an integrated bent engagement feature 517.

The sonde shoe 515 or "boss" or "cam" is an extension feature off the side of the sonde housing 510 that operates as a structural offset. As will become more apparent from a review of the following description, in operation the sonde shoe 515 lifts the sonde housing 510 off the wall of a bore to encourage pushing of the new leading end assembly 500 in a desired boring direction.

Returning to the illustrations, the sonde shoe 515 creates a portion of the sonde housing 510 that has an asymmetrical cross section, as opposed to cross sections that could be taken at other portions of the sonde housing 510. Advantageously, because the sonde shoe 515 creates the offset on one side of the sonde housing 510, the presence of the sonde shoe 515 operates to urge the new leading end assembly 500 to a direction opposing the position of the sonde shoe 515. In this way, the sonde shoe 515 "pushes" off the side wall of a bore to provide a mechanism for steering the new leading end assembly 500 much like may be done with a bent sub. Unlike a bent sub, however, the sonde shoe 515 is integrated to the sonde housing 510 and is virtually impervious to wear and in no need of calibrating relative to the sonde housing 510. Additionally, and as will become more apparent from a review of this description and subsequent figures, improved steering of the new leading end assembly 500 relative to prior art leading end assemblies may be realized as a result of the sonde shoe 515 being oriented or "clocked" to the tilted front face of a tilted-face bit; that is, the bit 520 (see FIG. 8) may be oriented relative to the sonde shoe 515 such that the front face facet 826 is positioned to face in the direction of boring urged by the sonde shoe 515.

In addition to the sonde shoe 515, the exemplary sonde housing 515 also includes an integrated bent engagement feature 517. The bent engagement feature 517 may also contribute to the overall effective bend range for embodiments of the new leading end assembly 500. As can be understood from the Figures, particularly FIGS. 6 and 7, the bent engagement feature 517 may be a threaded connection that defines a longitudinal axis 518 that is set at an angle (see alpha "a" label in FIGS. 6 and 7) relative to the longitudinal axis 516 defined by the drill string/elongate sonde body 510. The bent engagement feature 517 "bends away" from the sonde shoe 515, thereby contributing to the overall effective bend angle. Notably, the bent engagement feature 517 is integrated to the sonde body 510 and provides the means for mechanical connection of the sonde body 510 to next downstream component in the new leading end assembly 500, most likely hammer body 1 (as can be seen in the FIG. 5 illustration).

Figure 8A:
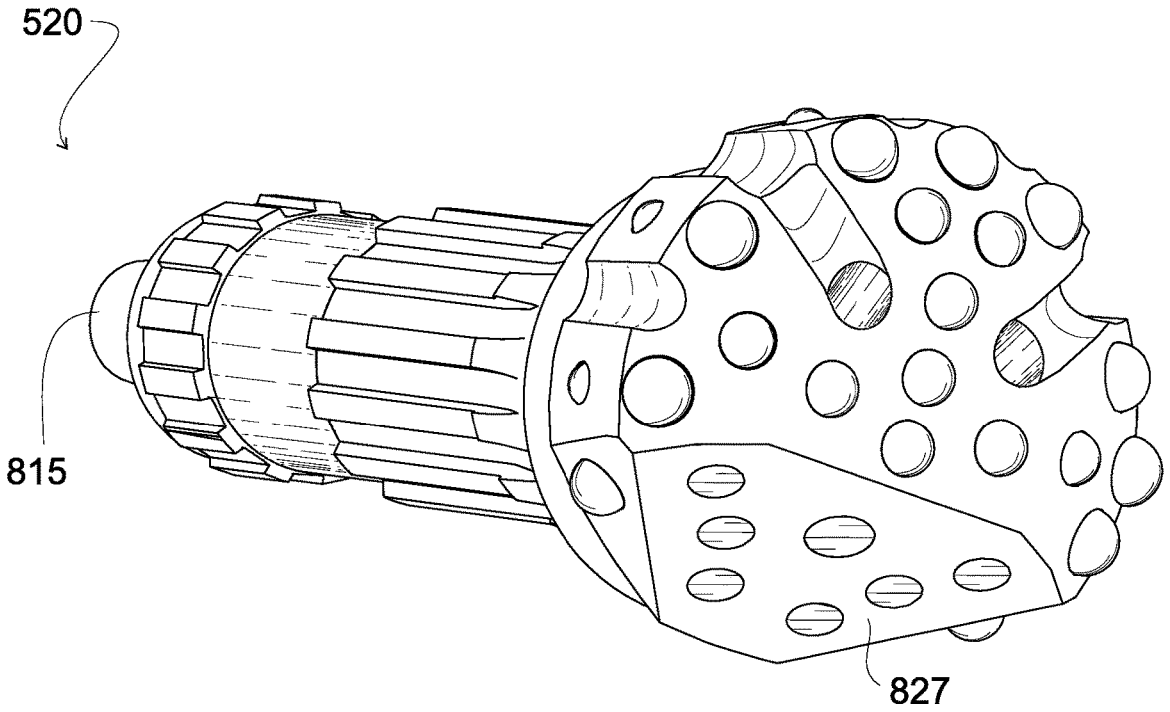
FIGS. 8A-8B are enlarged perspective and side views, respectively, of the exemplary tilted-face slant bit shown in FIG. 5.
Figure 8B:
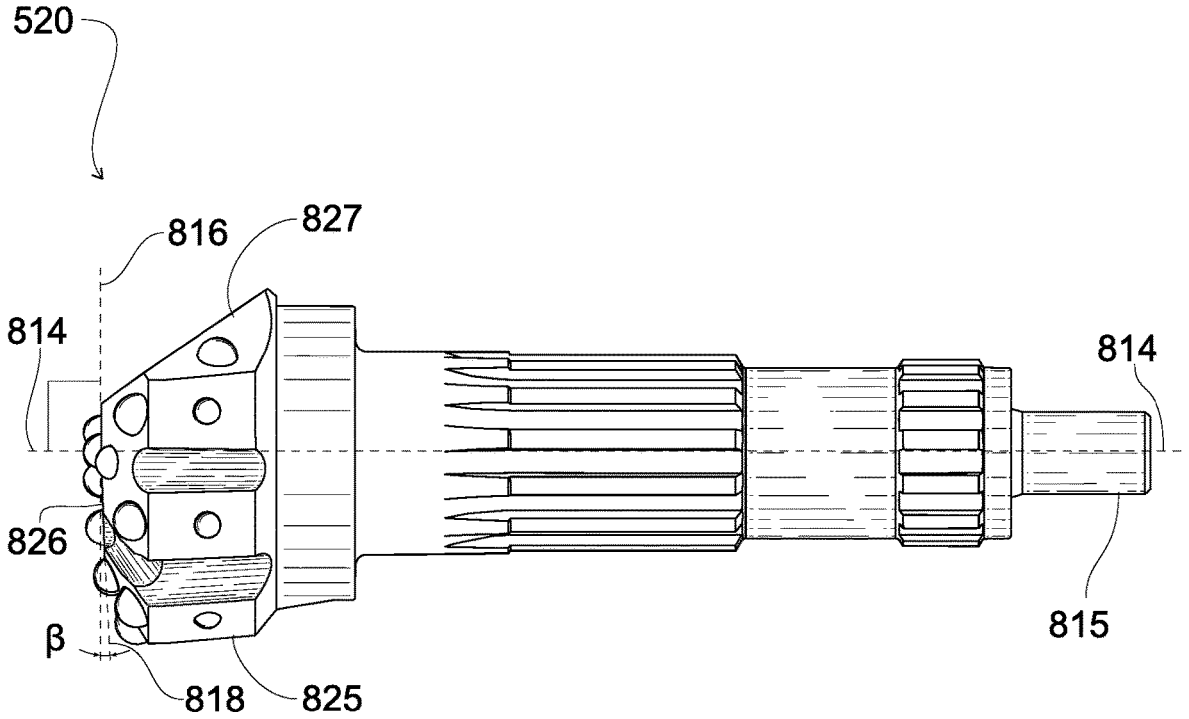

It is further envisioned that an amount of the effective bend range in embodiments of the new leading end assembly 500 may be attributable to a tilted-face slant bit 510. Referring to FIGS. 8A and 8B, enlarged perspective and side views, respectively, of an exemplary tilted-face slant bit 520 is shown. The tilted-face slant bit 510 includes a splined shaft for slidably engaging the tilted-face slant bit 510 to the chuck 35 (see FIG. 5). As explained above, the slidable engagement of a bit with a chuck, such as with tilted-face slant bit 510 and chuck 35, enables the bit to reciprocate in response to percussive strikes by a hammer piston in a leading end assembly for a percussion boring system.

As can be understood from the FIG. 8 illustrations, the tilted-face slant bit 520 comprises a head 825 with a front face facet 826 that defines a plane 818 that is tilted relative to a plane 816 that is perpendicular to the longitudinal axis 814 of the splined shaft (see angle beta "β" in FIG. 8B). Advantageously, in this way the tilted-face slant bit contributes to the overall effective bend angle of the new leading end assembly 500. As would be understood by those of ordinary skill in the art, typical drill bits used in the art at the time of this writing do not include a front face facet that is not substantially perpendicular to the longitudinal axis of the bit shaft. Advantageously, embodiments of the drill bit 520 that, unlike bits presently known in the art, do include a front face facet 826 that defines a plane 818 that is tilted relative to a plane 816 that is perpendicular to the longitudinal axis 814 of the splined shaft work to improve accuracy and precision during the pilot-channel boring process with a new leading end assembly 500.

A person having ordinary skill in the art understands that the accuracy and precision of a percussion boring process may not depend solely on aiming a leading end assembly. The alignment of the various components of the leading end assembly relative to one another, especially those components included in the drill bit portion of the assembly, may significantly affect the accuracy and precision of the percussion boring process when boring along a predetermined path and/or making relatively significant directional adjustments. This significant effect is magnified when the drill bit is asymmetrical; specifically, when the drill bit comprises a slant face facet aspect, such as the slant face facet aspect 827 in exemplary drill bit 520. As is understood by a person having ordinary skill in the art, a slant face facet aspect on a bit allows for more accurate and precise percussion boring in and of itself.

In an exemplary embodiment of the new tilted-face slant bit 520, the bit may be configured such that a front face aspect 826 the head 825 (as described above) defines an angle to be substantially within 0.25-15.00 degrees relative to the longitudinal axis 814 of the splined shaft. The result, as would understood by a person having ordinary skill in the art reviewing the FIG. 8 illustrations and this description, is a leading end assembly 500 with a drill bit 520 assembly that magnifies the asymmetrical effect during the boring process. The specific tilt angle "β" of the new tilted-face slant bit 520 may be application specific.

Unexpectedly, the new leading end assembly 500, with its sonde housing 510 having a sonde shoe 515 and bent engagement feature 517, and its drill bit 520 having a slanted front face facet aspect 826, allows an HDD system and method that is more accurate than known systems and methods. Using a known horizontal drilling rig and apparatus, an operator may adjust the orientation of the new leading end assembly 500 to steer along an underground boring path to achieve a drilling accuracy of from about 0.1% to about 2% course deviation.

Unexpectedly, it is an additional benefit of embodiments of the new leading end assembly 500 that the ability to adjust a drilling course is rapid. Embodiments of the assembly 500 may be adjusted in course over a 10 foot drilling length 4-20% faster than conventional solutions. For example, over a 10 foot drilling length, the course may adjusted from 4-10 inches in any radial direction relative to the status quo path. Such quick driving of a drilling rig is unexpected.

While an exemplary embodiment of a new leading end assembly for a percussion boring system has been described in detail herein, it is to be understood that the inventive concepts may be otherwise variously embodied and employed. The appended claims are intended to be construed to include such variations except insofar as limited by the prior art. Possible variations, as described throughout this disclosure, are not to be regarded as a departure from the spirit and scope of the invention. All such possible variations, as would be obvious to one skilled in the art, are intended to be included within the scope of the preceeding disclosure and the following claims.

It is understood that any variations of the features of the system and method described in the description section falls within the scope of the invention. There can be many embodiments of this invention as witnessed in some of the figures and the related description. Not all embodiments of a new leading end assembly for a percussion boring system that would fall within the scope of the claims are necessarily represented here.

In the description and claims of the present application, each of the verbs "comprise" "include" and "have", and conjugates thereof, are used to indicate that the object or objects of the verb are not necessarily a complete listing of members, components, elements, or parts of the subject or subjects of the verb.

The various embodiments have been described using detailed descriptions of the embodiments, as well as features, aspects, etc. thereof. The various embodiments are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described, and embodiments of the present invention comprising different combinations of features as noted in the described embodiments, will occur to persons with ordinary skill in the art.

It will be appreciated by persons having ordinary skill in the art that the present invention is not limited by what has been particularly shown and described herein above. Rather the scope of the invention is defined by the claims that follow.

What is claimed is:

1. A horizontal directional drilling system, comprising:

a drill string defining an associated first longitudinal axis; and a leading end assembly, comprising:

a substantially cylindrical sonde housing having an outer surface and an inner surface, the inner surface defining a substantially cylindrical internal space configured for containing sonde instrumentation, the substantially cylindrical internal space defining an associated second longitudinal axis through its geometric center, wherein the sonde housing comprises:

a shoe aspect on the outer surface that creates an asymmetrical cross section of the sonde housing when the sonde housing is cross-sectioned perpendicularly to the second longitudinal axis and simultaneously through both the internal space for containing sonde instrumentation and the shoe aspect; and a bent engagement feature;

a percussion hammer connected to the sonde housing via the bent engagement feature, wherein the bent engagement feature is configured to position the percussion hammer such that a third longitudinal axis associated with the percussion hammer intersects the second longitudinal axis associated with the sonde housing; and a tilted-face slant bit slidably connected to the percussion hammer via a chuck component and defining a fourth longitudinal axis associated with a shaft of the tilted-face slant bit, wherein a head of the tilted-face slant bit comprises a slant face facet and a front face facet, wherein the fourth longitudinal axis extends through the front face facet and the front face facet defines a plane that is tilted relative to a plane that is perpendicular to the fourth longitudinal axis.

2. The horizontal directional drilling system of claim 1, wherein the shaft of the tilted-face slant bit is splined.

3. The horizontal directional drilling system of claim 1, further comprising a sub-assembly of instrumentation within the sonde housing.

4. The horizontal directional drilling system of claim 1, wherein the shoe aspect, the bent engagement feature and the front face facet collectively form an effective bend angle, wherein the effective bend angle is defined by an intersection of the first longitudinal axis associated with the drill string and a fifth longitudinal axis perpendicular to the plane defined by the front face facet of the tilted-face slant bit.

5. The horizontal directional drilling system of claim 4, wherein the effective bend angle is in a range of substantially between 1.0°-15.0°.

6. The horizontal directional drilling system of claim 1, wherein the third longitudinal axis and the second longitudinal axis intersect to define an angle in a range of substantially between 1.0°-3.0°.

7. The horizontal directional drilling system of claim 1, wherein the plane defined by the front face facet is tilted between 0.25°-15.0° relative to the fourth longitudinal axis.

8. A horizontal directional drilling system, comprising:

a drill string defining an associated first longitudinal axis; and a leading end assembly without a bent sub component, the leading end assembly comprising:

a substantially cylindrical sonde housing having an outer surface and an inner surface, the inner surface defining a substantially cylindrical internal space configured for containing sonde instrumentation, the substantially cylindrical internal space defining an associated second longitudinal axis through its geometric center, wherein the sonde housing comprises:

a shoe aspect on the outer surface that creates an asymmetrical cross section of the sonde housing when the sonde housing is cross-sectioned perpendicularly to the second longitudinal axis and simultaneously through both the internal space for containing sonde instrumentation and the shoe aspect; and a bent engagement feature; and a percussion hammer connected to the sonde housing via the bent engagement feature, wherein the bent engagement feature is configured to position the percussion hammer such that a third longitudinal axis associated with the percussion hammer intersects the second longitudinal axis associated with the sonde housing.

9. The horizontal directional drilling system of claim 8, further comprising a sub-assembly of instrumentation within the sonde housing.

10. The horizontal directional drilling system of claim 8, wherein the third longitudinal axis and the second longitudinal axis intersect to define an angle in a range of substantially between 1.0°-3.0°.

* * * * *